United States Patent [19]

Knickerbocker

[11] 4,435,135

[45] Mar. 6, 1984

[54] PUMP ASSEMBLY WITH IMPROVED SEAL

[75] Inventor: Michael G. Knickerbocker, Crystal Lake, Ill.

[73] Assignee: Seaquist Valve Company, Cary, Ill.

[21] Appl. No.: 250,573

[22] Filed: Apr. 3, 1981

[51] Int. Cl.[3] ..... F04B 21/04; F04B 39/10

[52] U.S. Cl. ..... 417/511; 417/550; 222/321; 222/383

[58] Field of Search ..... 417/547, 550, 511, 512, 417/566; 222/321, 383

[56] References Cited

U.S. PATENT DOCUMENTS

| | | | |
|---|---|---|---|
| 2,509,204 | 11/1950 | Van Ranst et al. | 417/566 |
| 2,984,190 | 5/1961 | Dibley et al. | 417/550 |
| 3,257,961 | 6/1966 | Schlinker | 417/547 |
| 3,724,726 | 4/1973 | Susuki | 222/321 |
| 3,940,028 | 2/1976 | Beard | 222/321 |
| 3,949,910 | 4/1976 | Focht | 222/321 |
| 3,954,354 | 5/1976 | Boris | 417/553 |
| 4,050,860 | 9/1977 | Boris | 417/553 |
| 4,063,854 | 12/1977 | Hayes | 417/552 |

*Primary Examiner*—William L. Freeh

*Attorney, Agent, or Firm*—Dressler, Goldsmith, Shore, Sutker & Milnamow, Ltd.

[57] ABSTRACT

A hand-actuatable pump assembly is adapted to be sealingly secured to the mouth of a container for dispensing material in the container. The pump assembly includes a generally tubular adapter that defines a discharge passageway. A spray member is seated on the adapter and defines a discharge opening in communication with the passageway. A stem defines a tubular portion that is secured to the adapter. A valve body defines a pressure chamber. A piston sealingly and slidably engages the wall of the valve body. The piston comprises a first portion that is clamped between the stem and the adapter, and a second deflectable portion in sealing engagement in a position of rest with the stem, and being out of sealing engagement with the stem in a second position of actuation. The deflectable portion of the piston is deflectable in response to hydraulic pressure upon movement of said piston downwardly into the valve body to expose the passageway to communication with the pressure chamber.

9 Claims, 7 Drawing Figures

FIG. 1
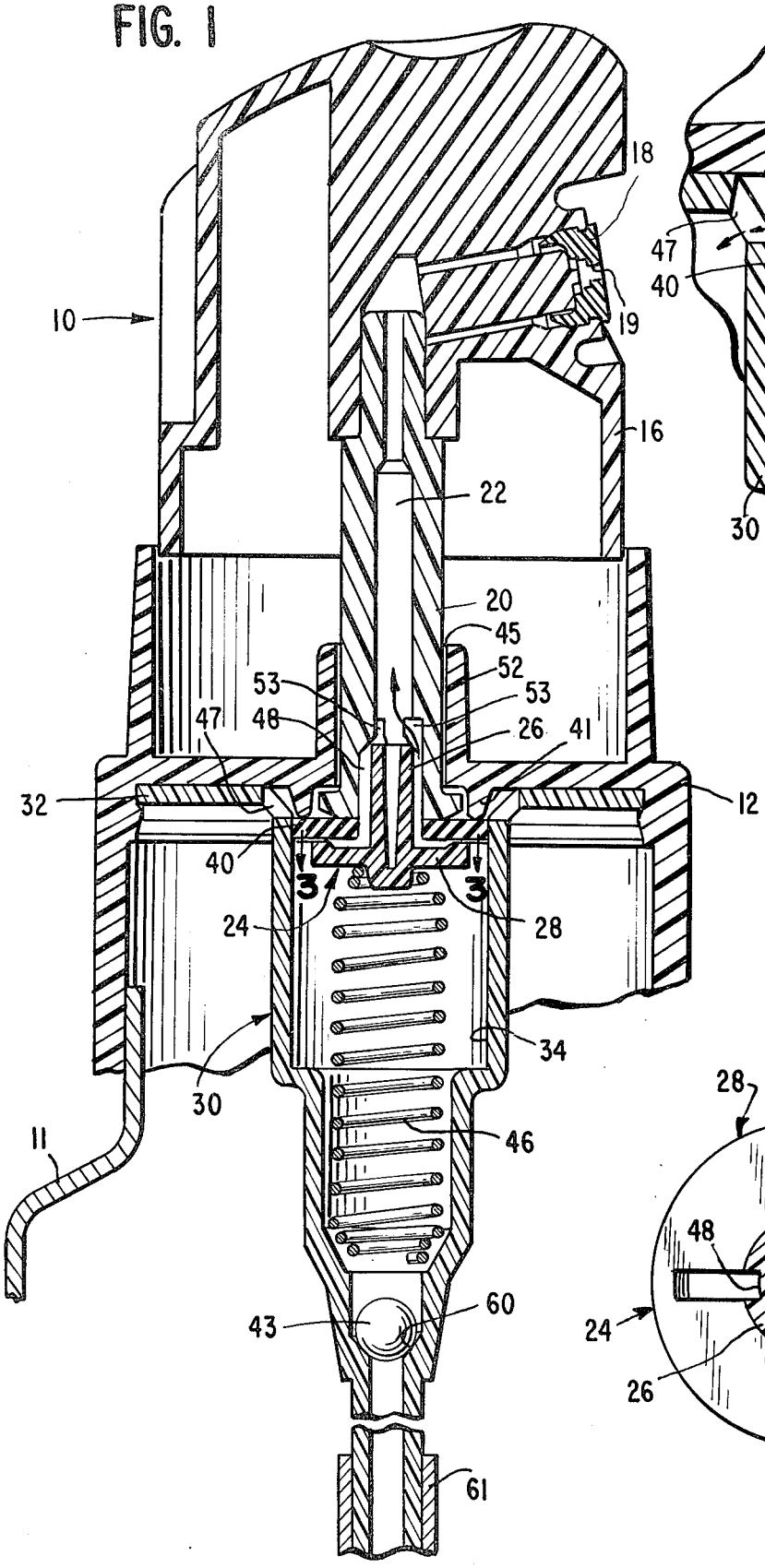
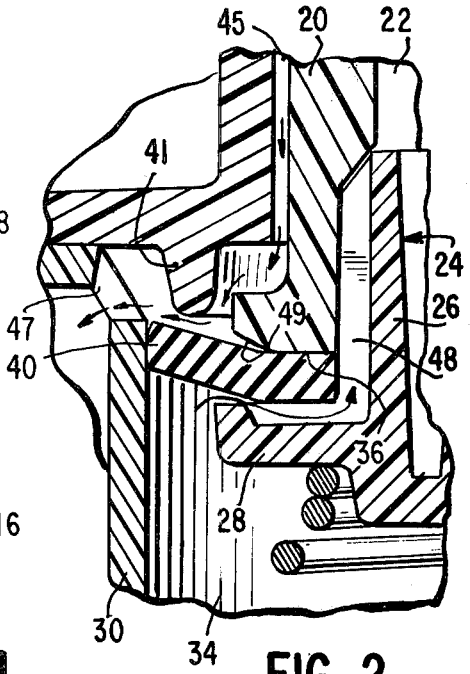
FIG. 2
FIG. 3
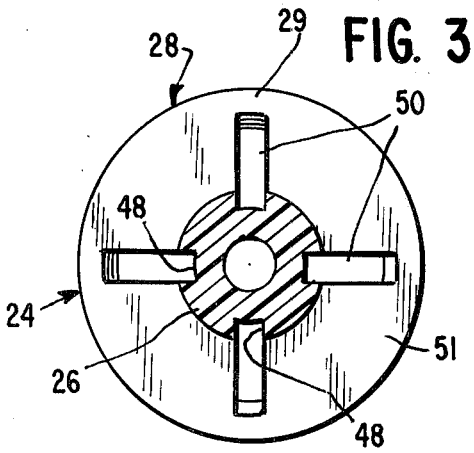

PUMP ASSEMBLY WITH IMPROVED SEAL

TECHNICAL FIELD OF THE INVENTION

This invention relates to dispenser pumps for dispensing atomized liquid from a container.

BACKGROUND OF THE INVENTION

A variety of pump dispensers are available for dispensing a number of products in the form of atomized liquid. To dispense liquid, the liquid which is stored in the container must pass through a valve in order to enter a passageway which communicates with a discharge opening.

In conventional dispensers, a seal is formed between two members to block the passageway when the dispenser is closed, and to open the passageway to permit liquid to be dispensed when the dispenser is in the open position. A number of prior art patents disclose a pair of essentially non-deformable members that sealingly engage one another to block the passageway when the dispenser at rest, and which are mechanically moved apart from one another to open the passageway to dispense liquid. See, for example, U.S. Pat. Nos. 4,050,860 to Beres and 4,063,854 to Hayes et al.

Other patents, such as U.S. Pat. No. 3,949,910 to Focht, disclose an arrangement in which a seal has a fixed edge and an opposite free portion which is mechanically moved from a discharge passageway-closed position and a discharge passageway-open position.

The arrangements disclosed in those patents are disadvantageous in that the members are mechanically moved out of engagement with each other when moving from the closed to the open position, and are mechanically held apart while maintaining the open position. This is disadvantageous in that the passageway may be open even when there is insufficient pressure for dispensing liquid; it is only after the members are mechanically moved to the closed position that the passageway is again sealed closed.

Another arrangement is shown in U.S. Pat. No. 3,940,028 to Beard wherein a seal closes the passageway in the closed position, and the entire seal tilts and assumes a dish-shaped configuration in the open position to permit liquid to be dispensed. The Beard arrangement is also disadvantageous because the passageway tends to remain open until the members are mechanically moved to the closed position.

SUMMARY OF THE INVENTION

The foregoing disadvantages of the prior art referred to are overcome in accordance with the present invention which relates to an improved dispenser construction wherein a seal or piston has a clamped portion, and a deflectable portion that is movable in response to fluid pressure. The deflectable portion of the piston closes off the passageway in the closed position, opens the passageway in the open position when there is sufficient fluid pressure, and automatically closes the passageway in the open position when the fluid pressure decreases.

More particularly, a hand-actuatable pump assembly in accordance with the present invention is adapted to be sealingly secured to the mouth of a container for dispensing material in the container. The pump assembly includes a generally tubular adapter that defines a discharge passageway. A spray member is seated on the adapter and defines a discharge opening in communication with the passageway. A stem defines a tubular portion that is secured to the adapter.

A valve body defines a pressure chamber. A piston sealingly and slidably engages the wall of the valve body. The piston comprises a first portion that is clamped between the stem and the adapter, and a second deflectable portion in sealing engagement in a position of rest with the stem to close the passageway, and being out of sealing engagement with the stem in a second position of actuation to place the pressure chamber and passageway in communication.

The deflectable portion of the stem is deflectable in response to hydraulic pressure upon movement of said piston downwardly into the valve body, thereby to expose the passageway to communication with the pressure chamber.

BRIEF DESCRIPTION OF THE DRAWINGS

Further features and disadvantages of the present invention will appear from the following description and drawings of presently preferred embodiments, in which:

FIG. 1 is a fragmentary cross-sectional view of a pump assembly of this invention as secured to a container, with the pump assembly shown in the upper non-dispensing or rest position;

FIG. 2 is an enlarged fragmentary cross-sectional view of the pump assembly of FIG. 1 in a lower dispensing position;

FIG. 3 is an enlarged cross-sectional view taken along line 3—3 of FIG. 1;

DESCRIPTION OF THE PREFERRED EMBODIMENTS

Figure 4:
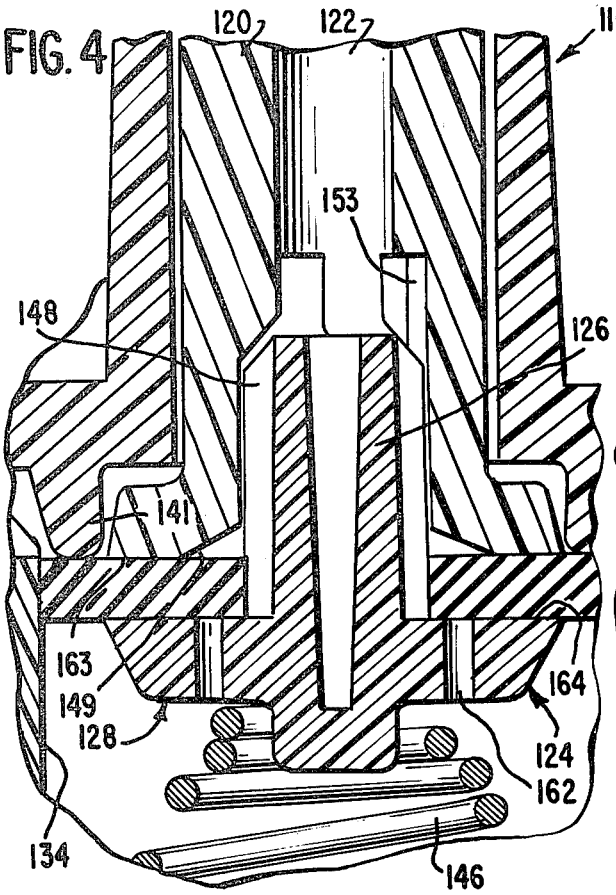
FIG. 4 is a fragmentary cross-sectional view of another embodiment of the pump assembly of this invention in the upper non-dispensing or rest position.

While this invention is susceptible of embodiment in many different forms, there is shown in the drawings and will herein be described in detail several embodiments of the invention, with the understanding that the present disclosure is to be considered as an exemplification of the principles of the invention and is not intended to limit the invention to the embodiments illustrated.

Referring now to the drawings, a presently preferred embodiment of the present invention comprises a hand-actuatable pump assembly 10 adapted to be secured to a container 11 such as a plastic bottle. Container 11 contains material to be dispensed, such as a deodorant, starch, hair spray, or the like.

The pump assembly includes a spray member or button 16 and defines a cavity in which a spray insert 18 is seated. Insert 18 defines a discharge opening, such as a spray orifice 19. The insert and orifice may be configured to develop a suitable spray pattern for the material to be dispensed in accordance with principles known in the art.

Spray button 16 is seated on and secured to an elongate adapter 20 which is circular in cross-section. The top end of the adapter is snugly received in a tubular recess defined by the spray button 16. The cylindrical adapter 20 defines a hollow continuous, axially extending passageway 22 through which material to be dispensed from the container is adapted to pass to the spray orifice for discharge.

A stem 24 is seated in an enlarged bottom end portion of the adapter. The stem includes a generally upstanding fluted portion 26 which is press-fit in the passageway 22 and a base 28 that extends generally radially outwardly from the lower end of the upstanding portion. The base has a peripheral edge 29 for sealing against the piston 40.

The pump assembly further includes a valve body 30 that is secured to a closure 12 by means of a collar portion 32. The valve body 30 defines an interior pressure chamber 34 for containing material to be dispensed through the spray orifice. A ball valve 43 is adapted to seal the base of the pressure chamber in a known manner.

A generally flat annular grommet or piston 40, preferably of an elastic material such as polyethylene or rubber, is positioned between the base 28 and the adapter 20. The piston 40 may be cylindrical. It has generally flat top and bottom surfaces, an inside edge defining a circular opening which is in snug engagement with the upstanding stem portion 26 and an outer edge which is in sealing engagement with the interior wall of the pressure chamber 34.

The stem, adapter and spray button are normally maintained in their upper position by means of a spring 46 which bears against the bottom of base 28 of the stem. The stem and adapter are maintained against tilting and for vertical or axial movement via the close slide fit between the upstanding closure collar 52 and the adapter 20.

As best seen in FIG. 3, the fluted vertical portion 26 of stem 24 defines a plurality of vertically extending grooves 48. These grooves terminate downwardly in complementary radially extending channels 50 defined in the upper surface of base 28. The channels 50 terminate radially outwardly adjacent the peripheral edge 29 which is a continuous sealing surface. The space between the channels 50 comprises land areas 51.

As will be seen in FIG. 1, when the pump assembly is in a position of rest the piston is sealed against peripheral edge 29, preventing communication with channels 50. However, when the piston and stem and adapter are moved downwardly, thereby increasing pressure in the pressure chamber 34, the outer portion of the piston is displaced relatively upwardly of the edge 29, and a flow path is provided over that edge, through channels 50, grooves 48, thence upwardly.

The upper end of the stem portion 26 is spaced away from the lower end of the confronting adapter passageway surface, thus permitting fluid to pass upwardly from grooves 48, through passageway 22 and out through orifice 19. To facilitate this, in the embodiment shown, three relatively wide recesses 53 are provided in the adapter, assuring communication between at least one of the grooves 48 and the upper reaches of passageway 22.

The pump assembly of this invention is also leakproof. To that end, the piston seals not only against edge 29, but it also seals against the wall of chamber 34 preventing communication between the chamber and the upper surface of the piston. A supplementary seal is provided between the upper surface of the piston and a depending collar 41 on the closure 12. Thus when the pump assembly is in the rest position of FIG. 1, the piston is urged into sealing engagement with the collar 41. Further upward movement is controlled by the edge 29 which extends radially about as far outwardly as the collar 41.

To use the pump assembly of this invention, the button is depressed and the stem and adapter move downwardly. The ball 43 is firmly sealed against the seat 60 at the bottom of chamber 34. As that occurs, the frictional engagement between the chamber wall and the increase in hydraulic pressure in the chamber 34 force the portion of the piston over the edge 29 upwardly. As a result, the contents of the pressure chamber are forced over the edge 29 through grooves 48, through channels 50, through recesses 53 and into the passageway 22. When the stroke is completed, the pressure decreases, the discharge of liquid stops and the piston again seats against the stem edge. As the stem returns to the upper position, the piston is positively forced against edge 29, assuring the closing off of communication between chamber 34 and discharge orifice 19.

When the spray button 16 is released and rises under the restoring influence of spring 46, the ball valve 43 becomes unseated under the influence of the negative pressure developed in the pressure chamber, and liquid rises through a dip tube 61, at the lower portion of the body 30. The liquid passes under and around ball valve 43 and refills the pressure chamber 34.

As liquid is admitted to the pressure chamber, a negative pressure would tend to develop in the container if venting did not occur. Therefore, to maintain atmospheric pressure in the container, ambient air is permitted to replace withdrawn liquid. To facilitate that, the container interior communicates with ambient atmosphere through passageway 45, the slight space between adapter 20 and collar 49, which is in communication with openings 47 in the valve body adjacent the collar portion when the seal between the piston 40 and the collar 41 is broken. This occurs on the downstroke, and permits air, as shown by the arrows in FIG. 2, to enter the container on the upstroke of the adapter.

In the embodiment illustrated in FIGS. 1, 2 and 3, the inner portion of the piston 40 is clamped between land areas 51 and the confronting portion 36 of adapter 20. The press fit between the stem portion 26 and the adapter facilitates this, thereby providing a positive gripping of the piston as the button is depressed and is permitted to rise. Thus the piston is positively moved by the valve assembly. Preferably, the adapter provides an adjacent relieved portion, such as bevelled portion 49 which accommodates flexure of the outer portion of the piston when it is forced upwardly by the liquid on the discharge portion of the stroke.

Other embodiments are illustrated in FIGS. 4 through 7. Numerals between 10 and 99 have been used to refer to the embodiment illustrated in FIGS. 1, 2 and 3, numerals in the 100 series are used to refer to the embodiment of FIGS. 4 and 5, and numerals in the 200 series are used to refer to the embodiment of FIGS. 6 and 7. The same last two digits in each numeral designate similar elements in the various embodiments.

Figure 5:
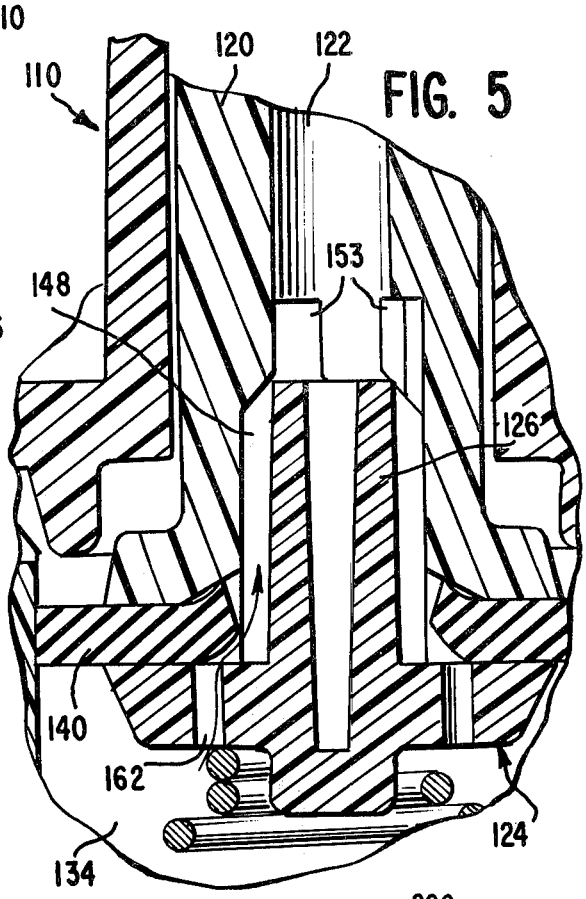
FIG. 5 is a fragmentary cross-sectional view showing the pump assembly of FIG. 4 in a lower dispensing position.

Referring to FIGS. 4 and 5, the pump assembly 110 may be the same as pump assembly 10 except that the base of the adapter 120 and portions of the stem 124 are differently configured. Thus pump assembly 110 includes a stem 124 that includes an upstanding fluted portion 126 and a base 128 that extends radially outwardly. The upstanding portion 126 of the stem defines a plurality of axially extending grooves 148 along the outside surface. The upper end of each groove 148 communicates through recesses 153 with passageway 122.

The base 128 defines a plurality of apertures 162 (such as four) that extend between the bottom and top surfaces of the base. The top surface 164 of the base is generally flat and, in contrast to the embodiment of FIGS. 1–3, does not define any channels.

The adapter 120 has a sealing surface 163 that is always in engagement with the piston 140. The press-fit between the stem portion 126 and adapter 120 maintains the sealing surface 163 and top surface 164 in clamping sealing engagement with the piston 140 in their confronting zones.

The piston 140 is adapted to seal against the wall of the pressure chamber 134 and to seal against collar 141 in the same manner as piston 40. However, because the piston 140 is sealingly clamped between the confronting portions of stem 124 and adapter 120 in the manner shown, upon movement of the piston downwardly the outer portion will not deflect to permit fluid to pass into grooves 148. Instead, in this embodiment, liquid will be forced upwardly through apertures 162 which will hydraulically unseat the inner edge of piston 140 permitting liquid to pass into grooves 148. To facilitate this the adapter 120 is relieved, as by bevel 149 to allow the inner edge of the piston to move sufficiently relatively upwardly to permit liquid to flow freely upwardly, all as illustrated in FIG. 5. In the position of rest, and as the piston is returning from a down position to the position of rest, the inner portion of the piston lies closely against the upper surface of the base 128 and seals apertures 162 from communication with the passageway 122.

As shown in FIGS. 4 and 5, the base 128 has an inner portion and an outer portion. The portion of the piston that is clamped in position is held between the stem 124 and the outer portion of the base. The apertures 162 extend through the inner portion of the base, and the bevel 149 in the adapter is spaced above the inner portion of the base.

Figure 6:
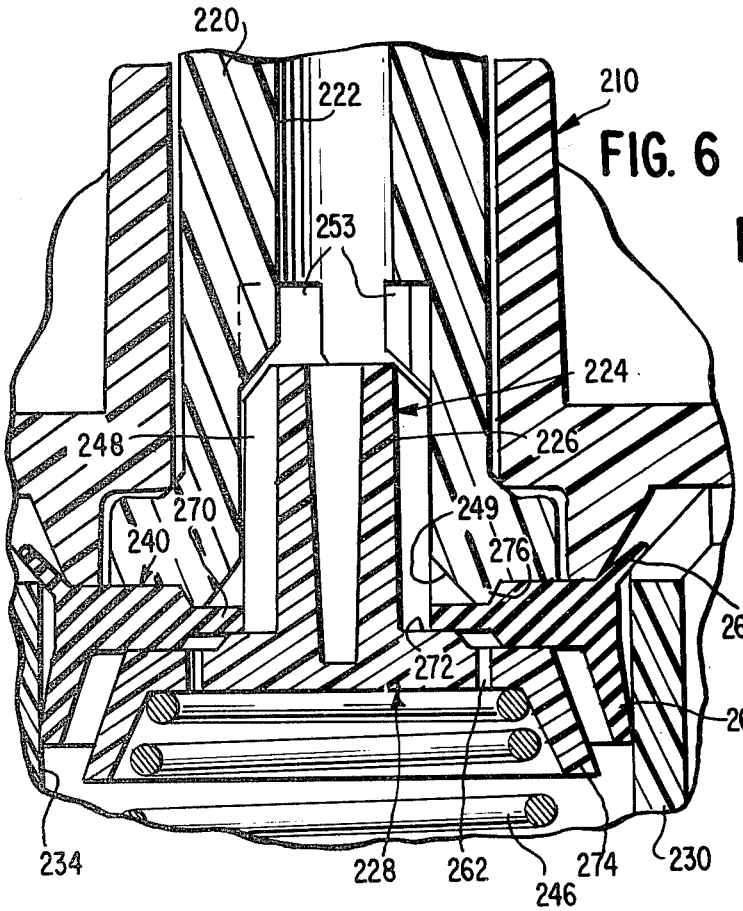
FIG. 6 is a fragmentary cross-sectional view of a further embodiment of the pump assembly of this invention in the upper non-dispensing or rest position.
Figure 7:
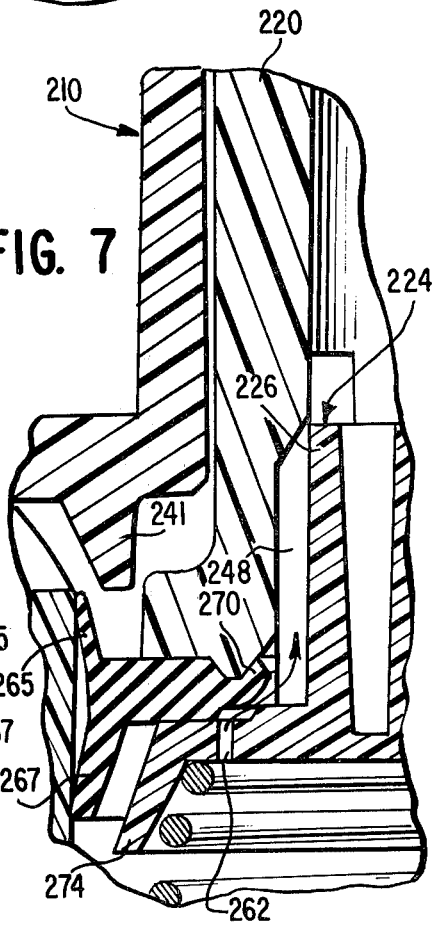
FIG. 7 is a fragmentary cross-sectional view of the pump assembly of FIG. 6 in a lower dispensing position.

Referring to FIGS. 6 and 7, the pump assembly 210 may be the same as pump assemblies 10 and 110 except that the piston 240, the base of the adapter 220, and portions of the stem 224 are differently configured.

Pump assembly 210 includes a stem 224 that includes an upstanding fluted portion 226, a base 228 which extends radially outwardly from the bottom end of the upstanding portion, and an annular skirt 274 that extends generally downwardly and outwardly from the outer end of the flange. The skirt 274 confines the spring 246 which biases the stem into the upper position of rest.

The upstanding portion 226 of the stem defines a plurality of axially extending grooves 248 along the outside surface. The upper end of each groove 248 communicates through recesses 253 with the passageway 222.

The base 228 defines a plurality of apertures 262 that extend between the bottom and top surfaces of the base.

The piston 240 is adapted to seal against the wall of the pressure chamber 234 and to seal against collar 241 in the same manner as pistons 40 and 140. However, the outer end of the piston 240 includes flared portions 265 and 267 that sealing engage the wall of the pressure chamber 234 at spaced apart locations to prevent flexure of the outer edge of the grommet. Flared portion 265 extends generally upwardly and outwardly, and flared portion 267 extends generally downwardly and outwardly.

This embodiment is similar to the embodiment of FIGS. 4 and 5 inasmuch as downward movement of the piston 240 forces fluid upwardly through apertures 262 to unseat the inner portion 270 of the piston, thereby to permit liquid to pass into grooves 248. To facilitate flexing of the inner portion 270 of the piston, it has a reduced thickness. Flexing is further facilitated by relieving the adapter, as by bevel 249, to allow the inner portion of the piston to move sufficiently to permit fluid to flow freely upwardly, as depicted in FIG. 7.

In the rest position shown in FIG. 6, and as the piston is returning from the down position to the rest position, the inner portion 270 of the piston lies closely against the raised step 272 on the base 228 of the stem. The inner portion of the piston sealingly engages the top of the step 272 to close off the apertures 262 from communication with the passageway 222.

The step 272 is provided because, in the embodiment illustrated in FIGS. 6 and 7, the reduced thickness of the inner portion 270 of the piston requires the base of the stem to be raised to engage the inner portion 270. Similarly, the bottom of the adapter 220 must be lowered to contact the inner portion 270, and a ring 276 is provided that extends downwardly from the adapter. The ring engages the piston at the juncture of the inner portion 270 and the adjacent middle portion of the piston, and facilitates in positioning the piston between the adapter and the stem. The bevel 249 is provided on the ring 276.

All of the foregoing embodiments provide improved performance because one portion of the piston is fixed in position, and a free portion of the piston is adapted to flex in response to hydraulic pressure to enable the liquid to be dispensed. Leaking is minimized because the free portion automatically returns to the unflexed position to close off access to the spray orifice even when the stem is in the lowered position, once the pressure is reduced due to the spraying of the liquid. Leakage is also reduced because only a portion of the piston flexes, so that good sealing engagement between the piston, the stem, and the adapter can be maintained at all times.

It is a further advantage of this invention that a relatively direct flow path is provided between the pressure chamber and the spray orifice. The efficiency of the pump is improved by minimizing the length of the flow path.

From the foregoing, it will be observed that numerous variations and modifications may be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. A hand-actuatable pump assembly adapted to be sealingly secured to the mouth of a container for dispensing material in the container, comprising:

a generally tubular adapter defining a discharge passageway, a spray member seated on said adapter and defining a discharge opening in communication with said passageway, a stem defining a portion secured to said adapter, a valve body defining a pressure chamber, and a piston having flat top and bottom surfaces sealingly and slidably engaging the wall of said valve body, spring means biasing said stem upwardly, said piston comprising a first portion clamped between confronting surfaces of said stem and said adapter, and a second deflectable portion in sealing engagement with said stem in a position of rest and being out of sealing engagement in a second position of actuation, said deflectable portion confronting a relieved portion of said adapter accommodating flexure of said deflectable portion of said piston, said deflectable portion of said piston being deflectable in response to hydraulic pressure upon movement of said piston downwardly into said valve body to expose said passageway to communication with said pressure chamber, whereby when said deflectable portion is deflected, said clamped portion remains clamped between said confronting surfaces of said stem and said adapter.

2. A hand-actuatable pump assembly as set forth in claim 1 wherein said piston has a generally flat top surface and a generally flat bottom surface.

3. A hand-actuatable pump assembly as defined in claim 1 wherein said stem portion that has an outside surface which defines a plurality of longitudinally extending grooves that communicate with said passageway and said pressure chamber when said piston is moved downwardly into said valve body.

4. A hand-actuatable pump assembly as defined in claim 3 wherein said stem portion is upstanding and said stem includes a base that extends generally radially outwardly from said upstanding portion to a peripheral edge, said base has an upper surface that defines a plurality of channels that each have one end in communication with one of said grooves and an opposite end that is spaced from said peripheral edge, the space between said channels and said peripheral edge comprising land areas.

5. A hand-actuatable pump assembly as defined in claim 4 wherein said piston has an inner portion and an outer portion, and said first portion comprises said inner portion of said piston and said second deflectable portion comprises said outer portion of said piston.

6. A hand-actuatable pump assembly as defined in claim 5 wherein said piston sealingly engages said peripheral edge when in said rest position and is out of sealing engagement with said peripheral edge when in said second position of actuation.

7. A hand-actuatable pump assembly as defined in claim 6 wherein the peripheral edge is spaced away from the lower end of the confronting adapter surface to permit fluid to pass from said pressure chamber to said channels, to said grooves, to said passageway, and to said discharge opening when said piston is in said second position.

8. A hand-actuatable pump assembly as defined in claim 3 wherein said stem includes a base that extends generally radially outwardly from said upstanding portion, said base having a bottom surface and a top surface, said base having an outer edge and an inner portion, said inner portion of said base defining a plurality of apertures extending from said bottom surface to said top surface, said piston having an inner edge, wherein said deflectable portion of said piston comprises said inner edge which sealingly engages the area around each of said apertures when said piston is in said rest position and is deflectable away from said inner portion of said base to expose said passageway to communication with said pressure chamber.

9. A hand-actuatable pump assembly as defined in claim 8 wherein the inner portion of the base is spaced away from the lower portion of the confronting adapter surface to permit fluid to pass from said pressure chamber to said grooves, to said passageway, and to said discharge opening when said piston is in said second position.

* * * * *